United States Patent [19]

Gaborieau et al.

[11] 4,002,516

[45] Jan. 11, 1977

[54] HERMETIC CLOSURE

[75] Inventors: Jean-Yves Gaborieau, Velizy; Bernard Baumann, Courbevoie, both of France

[73] Assignee: CEBAL, Paris, France

[22] Filed: Sept. 24, 1975

[21] Appl. No.: 616,407

[30] Foreign Application Priority Data

Sept. 26, 1974 France ..... 74.33138
July 25, 1975 France ..... 75.23870

[52] U.S. Cl. ..... 156/69; 29/451; 29/453; 29/525; 156/73.4; 215/358; 220/234; 220/307

[51] Int. Cl.[2] ..... B32B 31/20

[58] Field of Search ..... 220/333, 334, 335–338, 220/359, 233, 237, 234 X, 307 X; 215/358 X, 354, 361; 156/73.4, 69; 29/235, 451, 453, 525; 264/23

[56] References Cited

UNITED STATES PATENTS 3,726,432 4/1973 Gentile ..... 220/234
3,804,287 4/1974 Balocca et al. ..... 220/307
3,824,138 7/1974 Karobath et al. ..... 156/69

*Primary Examiner*—Edward G. Whitby
*Attorney, Agent, or Firm*—Dennison, Dennison, Meserole & Pollack

[57] ABSTRACT

A hermetic closure cap of resilient thermoplastic material constructed so as to be removably securable in an aperture made in a rigid sheet.

This cap is retained by a normally non-deformable but laterally retractable part pressing against the edges of the rigid sheet defining the aperture and which cap is maintained in position before opening by a removable locking element which is inserted into a slot in the cap that is of similar cross-section to that of the locking element.

The sealing cap thus designed can be used, for example, in cans containing a beverage under pressure.

16 Claims, 8 Drawing Figures

HERMETIC CLOSURE

The invention relates to a closure device.

More specifically, the application relates to a closure device of thermoplastic material which can be fitted hermetically into an aperture in a rigid sheet, such as the flat wall of a tin can, and which can easily be removed.

Closure devices of this type have already been suggested in which a sealing cap is formed in situ and retained in the aperture by a retractable movable lip located inside the vessel. Such a sealing cap is described in French Patent Specification No. 2,052,045, filed on July 9, 1969.

As an alternative to forming this sealing cap in situ it has also been proposed that it could be formed in two distinct parts which are joined together by the action of internal tensioning through an aperture in the sheet in such a way that the edges of the aperture are gripped between the parts of the component; the component is then subjected to heating by ultrasonic means and a second tensioning. This process is described in French Patent Specificiation No. 2,094,200, filed on Feb. 6, 1970.

In practice, the use of these sealing caps and the process for fitting them have given satisfactory results from the point of view of packaging, but even when the sealing cap described in French Specification No. 2,052,045 was fitted by means of the process described in French Pat. No. 2,094,200, there still remained an obstacle to their use on a large scale; the rate of production was markedly reduced at the moment of joining the sealing cap to the lid.

In addition, the fact that the grip ring permitting the removal of the sealing cap was positioned on the surface of the lid presented the risk of its being partially torn off or unwittingly opened prematurely.

We have attempted therefore, to provide a device which firstly allows an increase in the rate of production and, secondly, improves still further, the quality of the seal by rendering it immune to the roughest handling conditions.

Thus the present invention provides a closure device of a thermoplastic material comprising a sealing cap adapted to be fitted hermetically into an aperture in a rigid wall of a vessel and to be retained therein by a rigid peripheral annular part. The annular part is adapted to be urged against the edge of the wall defining the aperture and which under the stress of tension on the sealing cap exerted towards the inside of the vessel folds back in the direction of the axis of symmetry of the said sealing cap around a hinged or articulated zone constituted by the bottom of an annular slot comprising side walls which are parallel over a substantial proportion of their height separating the annular part from a central part of the sealing cap. The hinged or articulated zone is located out of the plane of the aperture, and an annular locking member is provided which is adapted to be press-fitted into the annular slot and cooperates therewith in such a way that the annular locking member can only be separated from the annular slot by the positive application of an external force.

The present invention provides a sealing device of thermoplastic material, of which the part forming the sealing cap can be fitted hermetically into an aperture made in the generally flat rigid wall of a vessel in which it is retained. A substantially rigid annular part presses against the inside edge of the wall surrounding the aperture and, under the stress of a tension exerted towards the exterior of the vessel, folds back in the direction of the axis of symmetry of the sealing cap thus permitting the easy removal of the device. The annular part which folds back is connected to the central part of the sealing can by an articulated or hinged zone located somewhat below the level of the surface of the rigid wall and for the rest of its height it is separated from the central part by a circular slot which permits the insertion of an annular locking member of a section substantially equal to that of the slot thus forming a locking wedge. The side walls of the slot and the annular locking member are oriented in such a way that these two parts can only be separated by the deliberate application of external force. These side walls are parallel to the axis of the sealing cap for a substantial proportion of their height.

This annular locking member, the width of which is preferably slightly greater than that of the slot, can be joined to the sealing cap proper in various ways, for example by means of a flange sufficiently solid to permit the use of this annular element as a grip ring.

The annular locking member can also form the rim of a blind disc the central part of which is fixed to the central part of the component forming the sealing cap, the latter being connected to the peripheral part by a circular crown and by two concentric articulation zones, one inside and the other outside the crown.

The invention also provides a preferred process for fitting a sealing cap as just described. According to this process, after the positioning of the thermoplastic component, the area of this component which is in contact with the sheet to which it is to be joined, is heated locally until this area begins to soften. At this point the annular locking member is inserted into the slot by slightly displacing the outer wall so that hermetic contact is created between the edge of the rigid sheet and the area of the sealing cap component which it touches.

The localized heating is preferably effected by ultrasonics.

In order to maintain this close contact permanently it is useful to increase further the rigidity of the wall in the part surrounding the opening.

This rigidity reinforcement may be obtained, particularly in the case of a metal wall, by deforming the edge and shaping it in such a way that this area forms an angle with the plane of the rigid sheet. This angle should preferably be of the order of 45°. Thus the deformation can take the form of a V-section groove or rib the sides of which are at a right angle to one another.

The invention will be further illustrated by reference to the accompanying drawings, in which.

In a first preferred embodiment which lends itself in particular to the sealing of cans in which the contents are under pressure, for example beer cans, a lid 1, which can be slightly convex, bears a rib 2 in the form of an inverted V which defines an aperture; in the case of the exemplified embodiment, this aperture is a circular opening with a diameter of 2 cm.

Figure 1:
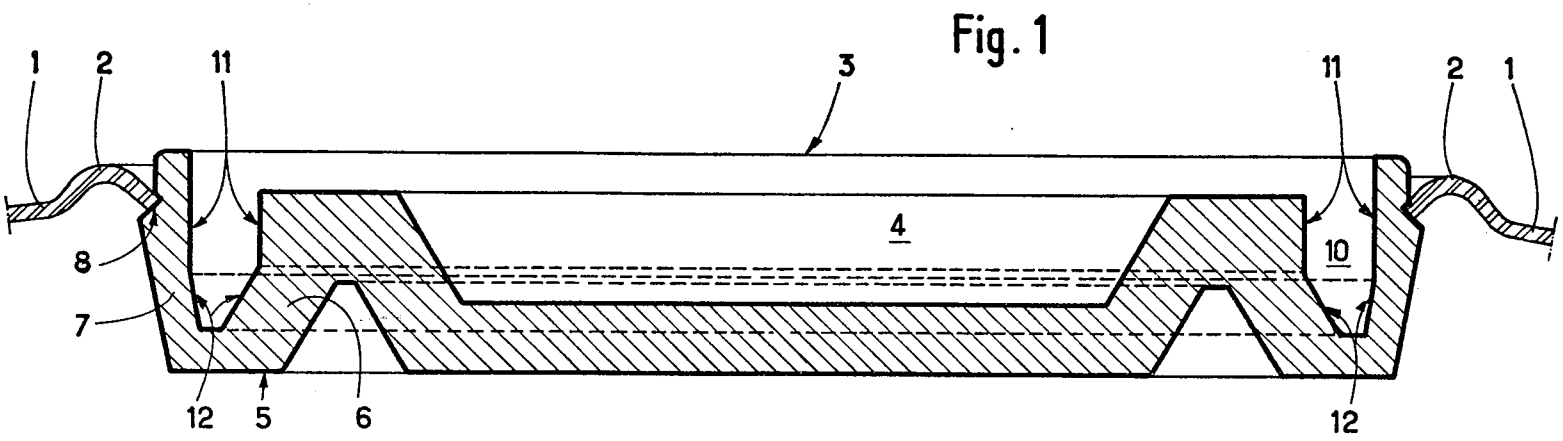
FIG. 1 shows a section through the axis of symmetry of a first embodiment of a sealing cap inserted into the aperture in a rigid wall.

A sealing cap 3 placed in this aperture is of thermoplastic material. Good results have been obtained with an injection moulded polypropylene having the following characteristics:

modulus of bending elasticity at ambient temperature; 12,300 kg/cm²
breaking load: 356 kg/cm²
breaking elongation: 605%
Brinel hardness: 695 kg/cm²
index of fluidity: grade 3
point of vitreous transition: 60° C
melting point: 167° C The central part of the sealing cap 3 can have various shapes. In the first example, illustrated by FIGS. 1 – 3, it is shaped like a dish 4 the edges of which rise perceptibly at the level of the lid 1. This central part 4 is surrounded by a peripheral part 5 with a U-section. The peripheral parts comprises an arm 6 connected to the raised edge of the dish 4 and an outer arm 7 which is slightly conical and having in its upper part a notch 8 into which an edge 9 of the aperture in the lid 1 is adapted to fit.

A circular slot 10 between the two arms, 6 and 7, of the peripheral part 5 of the sealing cap is defined at its upper part by two parallel surfaces 11 and at its lower part by two faces 12 which are inclined in relation to the parallel walls 11 and converge towards one another to define a trapezoidal section.

Figure 2:
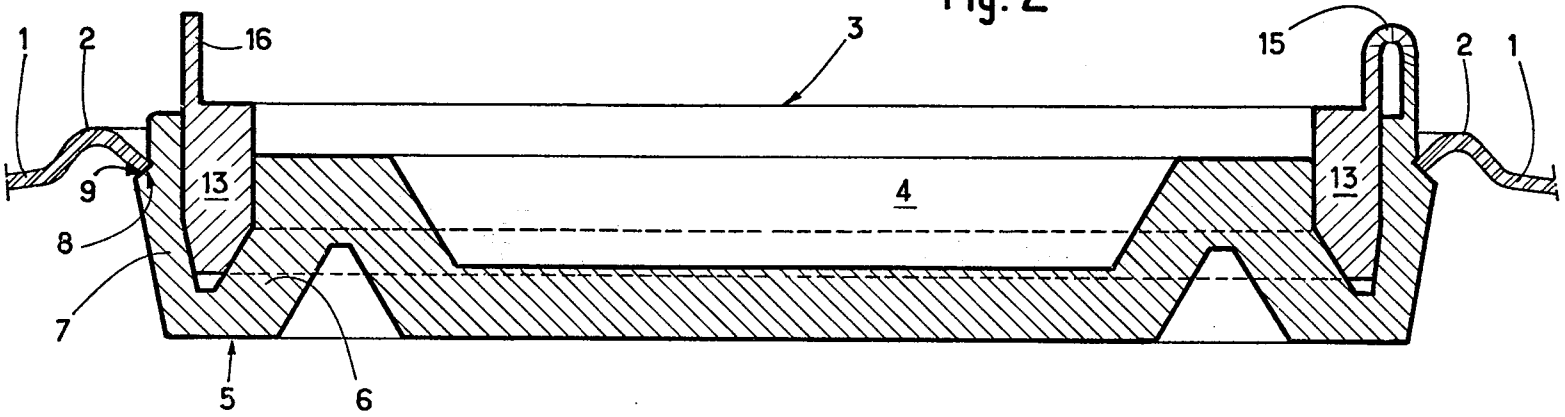
FIG. 2 shows a section through the axis of symmetry and a hinged flange which joins the sealing cap to an annular element after this has been introduced into the circular slot.
Figure 3:
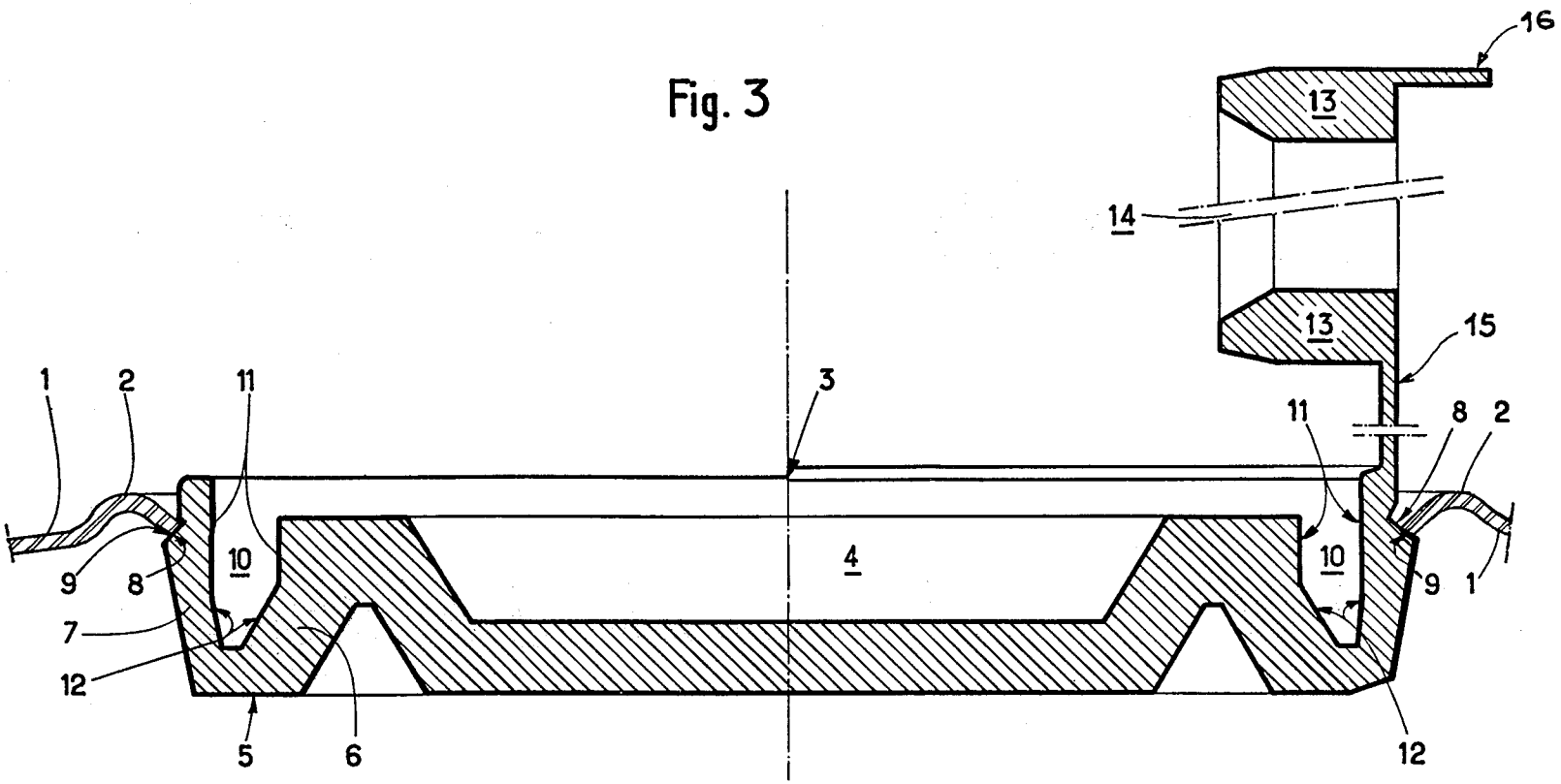
FIG. 3 shows a section as FIG. 2 in the same plane at the moment when the release of the sealing cap has just been initiated.

FIGS. 2 and 3 show a second element 13 of the sealing cap which is annular and has a section similar to that of the slot 10; the thickness of the circular element may be slightly greater than that of the width of this slot (by 0.3 mm for example). The annular locking member 13 is connected via a flange 15 to the peripheral portion 5 of the sealing cap; on the side opposite this flange, the annular locking member 13 is provided wth a tongue 16 which effects the removal of the annular locking member 13 from the slot 10.

The sealing cap is fitted in the following ways:

The sealing cap component 3, with the dish 4 open upwards, is inserted by pressure into the aperture in the lid 1 until the free edge 9 of the deformed section 2 lodges in the notch 8 of the outside arm 7 of the peripheral part 5 of the sealing cap 3. To prevent the total disappearance of the fitting into the aperture, it is preferable for the upper edge above the notch 8 in the arm 7 to project outwards a little way.

During fitting the annular locking member 13 can already be brought near to the slot 10 but is not yet fully engaged. Complete insertion is not effected until after the contact surface between the edge 9 of the lid and the oblique surface 8 of the notch has undergone heating.

Preferably, an ultrasonic heating process should be used whereby the nose (not shown) should be applied to the outside of the bottom of the dish 4 into which an anvil penetrates (which is also not shown in the drawings, as these two items are well known and described for example in the above mentioned French Pat. No. 2,094,200). In fact, this process provides not only heating and hence softening in a specific area and to a well determined degree, but also before the surface of the notch has been sufficiently softened to allow conformation under pressure of the thermoplastic material on the edge of the lid, the surfaces in contact have been completely cleaned of all foreign bodies, even microscopic, by the action of the ultrasonic waves, as numerous experiments have demonstrated.

This action only lasts for about 1/10th second and it is followed immediately by the introduction of the annular locking member 13 kept at ambient temperature into the slot 10 (FIG. 2). As it is preferable that once this operation is completed the outside diameter of the arm 7 should be slightly greater than that of the aperture made in the lid, the action of the annular locking member 13 will be that of a wedge and the contact between the edge 9 and the notch 8 will be reinforced by a mechanical action. The heating of the notch 8 is not essential in order to obtain the desired hermetic sealing, but is very useful in maintaining the closure in place because of the rough handling which these cans often have to undergo.

Cans sealed in this way, even if their contents are under pressure, can keep for as long as in a conventional package.

Opening them (FIG. 3) could not be simpler. By pulling the tongue 16 the locking member 13 is released and now functions as a grip ring. By inserting a finger into the hole 14 in this ring and pulling in a direction via the flange 15 and parallel to the axis of symmetry of the sealing cap, the notch 8 is released, at first into the extension of the flange fixing point, then around the whole circumference and opening can be effected without the need to exert a violent force.

From the above it will be seen that it will even be possible to reseal an opened can, not of course for a lengthy new period of storage, but, depending on the contents, for a few hours or even for several days. Therefore, it is advised to fit the grip-tongue 16 so as to be visible but not too solid, either on the lid itself or on a part of the sealing cap to permit the detection of fraudulent opening.

Figure 4:
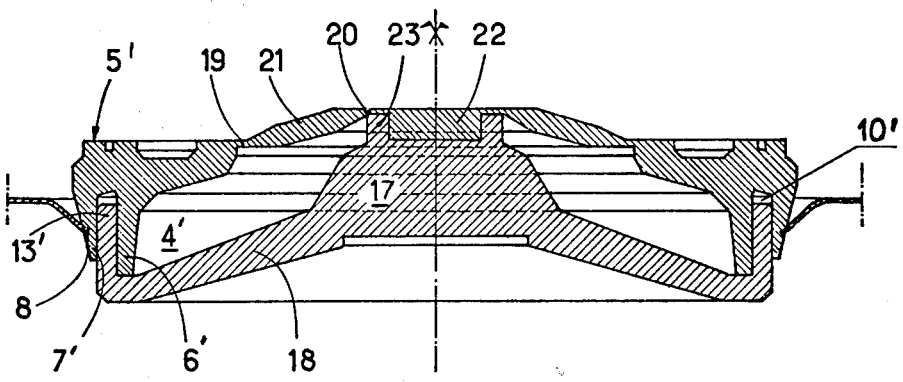
FIG. 4 shows a section through the axis of symmetry of a second embodiment form of a sealing cap in the closed position.
Figure 5:
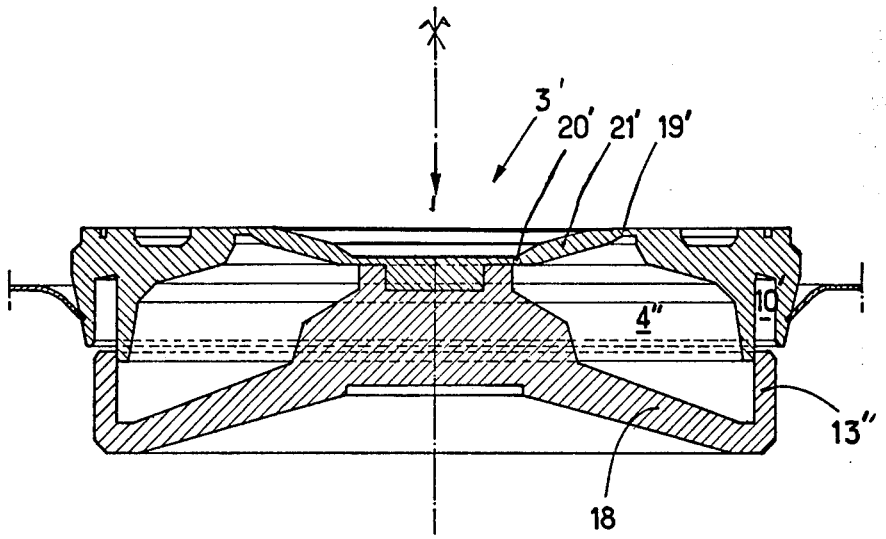
FIG. 5 shows the same section as FIG. 4 after release.

In another embodiment illustrated by FIGS. 4 and 5, the two elements of the sealing device, i.e. the sealing cap 3' and the annular locking member 13' can remain joined over their entire circumference even after the opening of the vessel. In this case the elements are inverted, i.e. the slot 10' is open downwards, towards the inside of the vessel, and the annular element 13' is oriented outwards and is joined to a thick, blind central part 17 by a circular crown 18.

The bottom of the dish 4' features two concentric circular articulation zones 19 and 20, connected by a rigid circular crown 21, with an articulation zone 20 surrounding the thickened section 22 which is joined, for instance, by friction on the dish 4 to a raised annular part 23 of the thick central part 17 of the locking member.

In FIG. 4 the annular locking member 13' is located in the circular slot 10' and is performing its locking function. In order to release this lock one has only to press from outside on to the central part 22 of the dish 4'; since this part is connected by two articulation zones 19 and 20 to the peripheral part 5', it is easily displaced inwards passing through a dead point when the two articulation zones 19 and 20 are in the same plane parallel to that of the lid.

By this movement the bottom of the dish 4' from concave becomes convex and pushes the central part 17 of the locking member towards the inside of the can. As the crown 18 is rigid it takes with it the annular locking member 13' which disengages from the slot 10'.

It should be noted here that the inside arm 6' of the inverted U-shaped peripheral part 5' should preferably be longer than the outside arm 7' and that when the annular locking member 13' reaches the end of its travel, it has completely disengaged from the outside arm 7' but remains in contact with the inside arm 6'. In this way, even after release the two components of the sealing cap 3' remain joined at their circumference and it becomes easier to disengage them from the aperture in the lid.

This disengagement can be effected either by means of a tongue (not shown) fitted for instance to the peripheral section 5' of the sealing cap component 3' or in certain circumstances where the pollution of the contents is not feared, by pushing in the whole of the seal.

This second embodiment can also be envisaged in a totally different application, namely as a safety valve. When used as such, it is located in a flat surface of a vessel but with the elements inverted, i.e. the bottom of the dish projects inwards into the vessel. In this case it is also preferable to invert or to dispense with any deformation of the wall in the proximity of the aperture. The articulation zones 19 and 20 should be designed in such a way that the dish resists a certain pressure but once this pressure is exceeded, the sealing cap is released.

Of course, many variants can be devised from this embodiment, as from the previous one, according to requirements.

Figure 6:
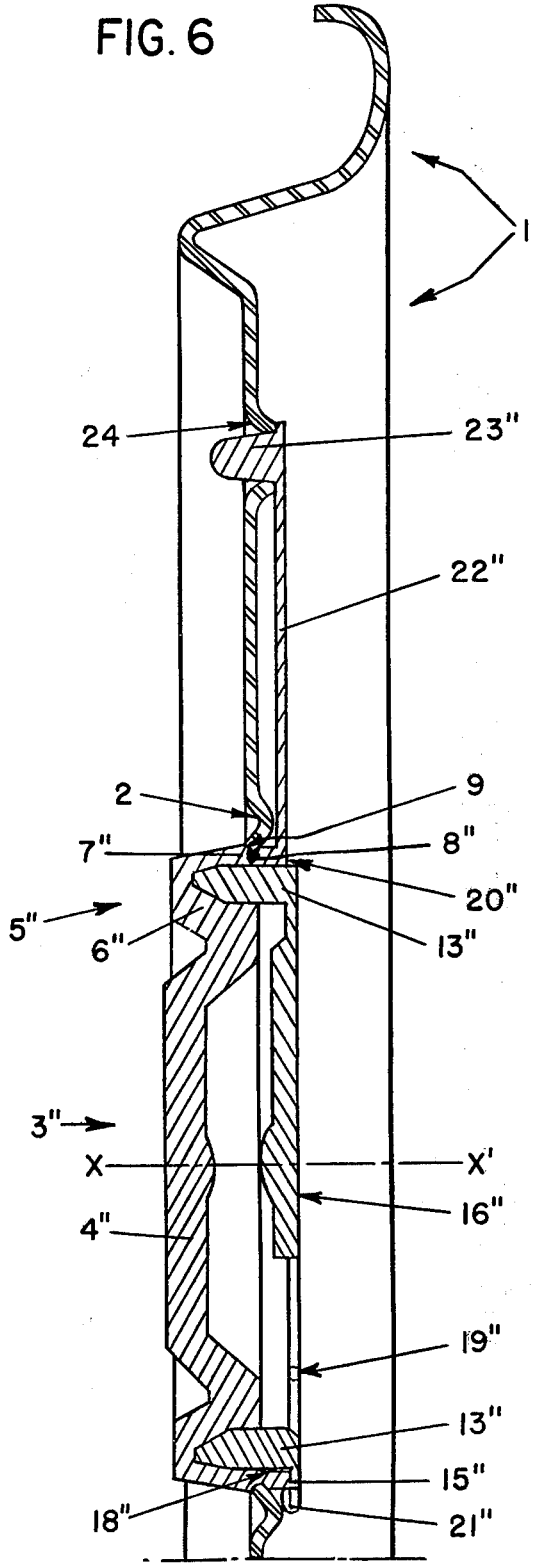
FIG. 6 is a section through a third embodiment of a closure device according to the invention in position in an aperture formed in a cover.

FIG. 6 shows the lid 1 of a can with its opening surrounded by a rib 2. The sealing cap 3'' is inserted into the aperture. The central portion of the sealing cap 3'' in the form of a dish 4'' is surrounded by a peripheral part 5'' of substantially U-shaped cross-section, the inner arm 6'' of the U-shaped peripheral part adjoining the edge of the dish 4'', while the outer arm 7'' comprises a notch 8'' in which engages the edge 9 of rib 2.

Figure 7:
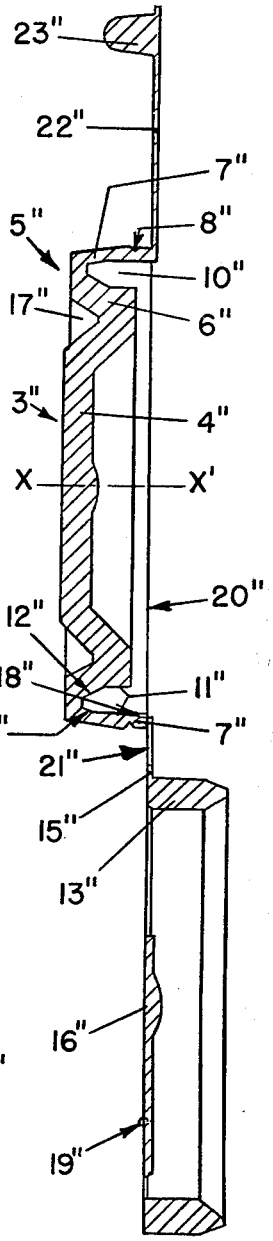
FIG. 7 is a sectional view of the closure device illustrated in FIG. 6 before its introduction into the aperture. The sealing cap and the annular locking member are shown separately.

FIG. 7 shows the slot 10'' separating the two arms 6'' and 7'' of the peripheral part. This slot 10'' is defined at its upper end by two substantially cylindrical lateral walls 11'' extending parallel to the axis XX' of the sealing cap. At their lower end, these walls terminate in two inclined, converging surfaces 12''.

Figure 8:
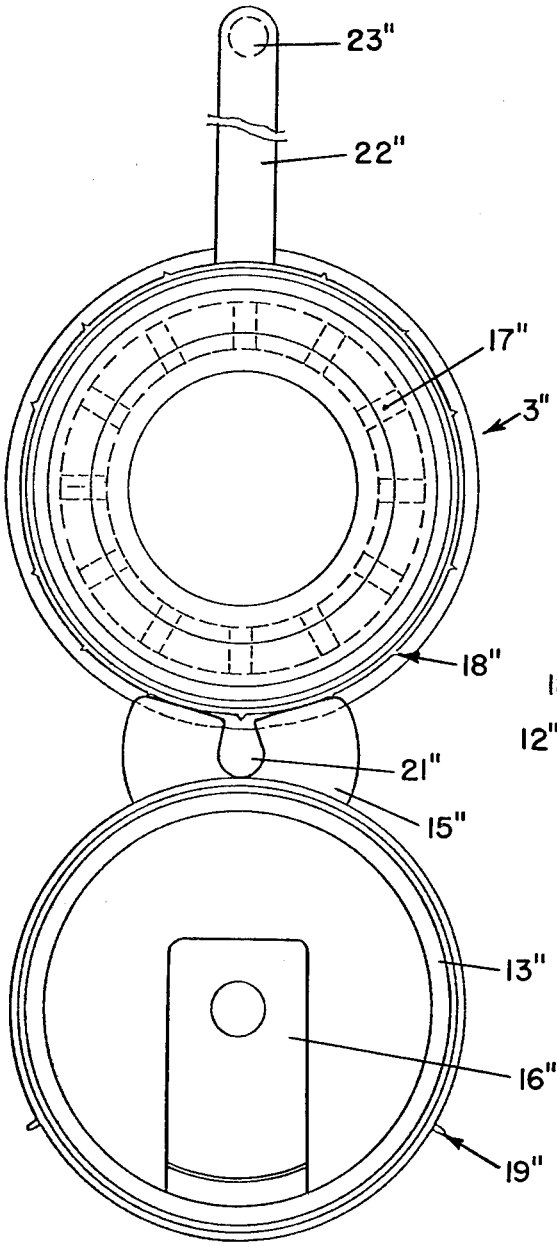
FIG. 8 is a plan view of the closure illustrated in FIGS. 6 and 7.

FIGS. 7 and 8 also show the second essential component of the closure namely the annular locking member 13'' whose cross-section substantially corresponds to that of slot 10'', the thickness of the locking member being very slightly greater than that of the slot. The annular member 13'' is joined to the peripheral portion of the stopper through a collar 15'', and is provided with a tab 16'' by which it may be gripped.

The embodiment illustrated in FIGS. 6 and 8 has the following additional improvements:

The peripheral part 5'' is rendered substantially nondeformable by virtue of the presence of radial grooves 17'' which connect the inner arm 6'' to the central dish 4''. These grooves 17'' strengthen the inner arm 6'' of the peripheral part 5'' without increasing the thickness of that peripheral part. The substantially constant thickness of the sealing cap makes it possible to mould the plastics material under favorable conditions and to obtain precise dimensional tolerances.

In order to counteract this rigidity, which promotes the fluid-tightness of the stopper when it is in use, flexibilising notches 18'' are formed on the inner surface of the outer arm 7''. These notches facilitate deformation of the outer arm 7'' during the introduction and removal of the annular locking member 13'', and removal of the sealing cap 3'' from the aperture when the container is opened by the consumer.

Small appendages 19'' are provided on the outer upper surface of the member 13''. They are welded, for example by ultrasonic welding, to the upper surface 20'' of the outer arm 7'' of the sealing cap 3'' after assembly. They render the closure completely tamperproof whereby.

The collar 15'' is thin and wide. At its center it is formed with a hole 21'' in order not to rigidify the outer arm 7'' of the sealing cap where it joins the collar 15''.

The sealing cap 3'' is connected through a collar 22'' to a small-diameter conical stud 23''. This stud 23'' engages in fluid-tight manner in a hole 24 formed in the panel of the lid 1. In cases where the metal cover is provided with an internal lining, the hole 24 is preferably formed outwards, as shown in FIG. 6. In this way, the contents of the can are prevented from coming into contact with the metal at the perforation. Thus, after opening by the consumer, the closure remains attached to the lid through the stud 23''. The closure complies ideally with the ecological requirements.

In the case of containers subjected to pressure, the opening in the lid 1 intended to receive the sealing cap 3'' wll preferably be formed substantially at the center of the lid in order to prevent deformation of the opening through variations in pressure.

By virtue of this particular embodiment of the closure according to the invention it is possible to close a 20 mm diameter opening reinforced by a V-shaped groove 2 0.4 mm deep. This closure is made of a copolymer of polypropylene and polyethylene. The dimensions of the annular locking member 13'' are substantially as follows:

External diameter 19 mm, internal diameter 16 mm, total height measured parallel to XX' 3.5 mm (2.5 mm for the cylindrical portion plus 1 mm for the portion of trapezoidal cross-section). The total height of the sealing cap 3'' is 3.5 mm. The thickness of the wall in the dish-shaped portion 4'' is substantially 1 mm. The grooves 17'' have a thickness of the same order. The stud 23'' has a diameter of 2 mm and a height of 2.5 mm.

We claim:

1. A closure device of a generally resilient material comprising a sealing cap adapted to be fitted heremetically into an aperture in a rigid wall of a vessel and to be retained therein by a generally rigid peripheral annular part which is adapted to be urged against the edge of a wall defining the aperture and which under the stress of a tension on the sealing cap exerted towards the inside of the vessel folds back in the direction of the axis of symmetry of the said sealing cap around a hinged or articulated zone constituted by the bottom of an annular slot comprising side walls which are parallel over a substantial proportion of their height separating the annular part from a central part of the sealing cap, the hinged or articulated zone being located out of the plane of the aperture, and an annular locking member which is adpated to be press-fitted into the annular slot and to cooperate therewith wherein the annular locking member can only be separated from the annular slot by the positive application of an external force.

2. A closure device according to claim 1 wherein the width of the section of the annular locking member is, in the part which penetrates into the annular slot, slightly greater than that of the said slot.

3. A closure device according to claim 1 wherein the annular locking member is integral with the sealing cap element.

4. A closure device according to claim 3 wherein the annular member is joined to the sealing cap by a flange connecting the outside edges of these two elements.

5. A closure device according to claim 1 wherein the annular locking member comprises the rim of a blind disc, the central part of which is fixed to the central part of the sealing cap, the latter being connected to the peripheral part of the sealing cap by a circular crown and by two concentric articulation zones one inside and the other outside the said crown.

6. A closure device according to claim 1 wherein the sealing cap includes radial grooves joining the inner arm of the peripheral part to the central part of the sealing cap.

7. A closure device according to claim 1 wherein one or more notches are formed in the inner surface of the outer arm of the peripheral part of the sealing cap.

8. A closure device according to claim 1 wherein the annular locking member includes appendages on its outer surface which are welded to the sailing cap to make the closure tamperproof.

9. A closure device according to claim 1 wherein a collar joining the annular locking member to the sealing ring includes a central hole.

10. A closure device according to claim 1 and further including stud means extending from a collar, said collar being connected to said closure, whereby said stud may be secured in an aperture in a container cover in order to insure retention of said closure.

11. A closure according to claim 1 wherein the aperture adapted to receive the sealing cap is formed substantially at the center of the lid.

12. A process for applying a thermoplastic sealing cap having an annular slot in the top surface thereof in a container having an aperture with a surrounding wall comprising the steps of;

a. locating said sealing cap within the container aperture;

b. locally heating the portion of said cap in contact with the edge of the surrounding wall until it begins to soften; and c. inserting an annular, nondeformable locking member into said annular slot while said cap portion is soft, whereby a hermetic seal is formed between the edge of said wall and the portion of said cap in contact therewith.

13. A process according to claim 12 wherein the localized heating is effected by ultrasonics.

14. A rigid wall provided with an aperture designed to receive a device according to claim 1 wherein the rigidity of the wall is reinforced in the part of the wall defining the aperture.

15. A wall according to claim 14 wherein in the case of a metal wall, the reinforcement of the rigidity is obtained by the deformation of the edge of the wall defining the aperture.

16. A wall according to claim 15 wherein the deformation involves the shaping of the area directly adjacent to the aperture in such a way that it forms an angle with the plane of the wall.

* * * * *